United States Patent [19]

Wörner

[11] 4,247,520

[45] Jan. 27, 1981

[54] EXHAUST MUFFLER WITH CATALYST

[75] Inventor: Siegfried Wörner, Esslingen am Neckar, Fed. Rep. of Germany

[73] Assignee: J. Eberspächer, Esslingen, Fed. Rep. of Germany

[21] Appl. No.: 20,727

[22] Filed: Mar. 15, 1979

[30] Foreign Application Priority Data

Mar. 17, 1978 [DE] Fed. Rep. of Germany ..... 2811651

[51] Int. Cl.[3] ..... F01N 3/20; F01N 3/28; F01N 3/30; F01N 7/08

[52] U.S. Cl. ..... 422/176; 60/299; 60/324; 422/180

[58] Field of Search ..... 422/176, 177, 179, 180, 422/220-222; 60/324, 299

[56] References Cited

U.S. PATENT DOCUMENTS

| | | | |
|---|---|---|---|
| 3,189,418 | 6/1965 | Gary | 422/176 |
| 3,495,401 | 2/1970 | Lenane | 60/324 |
| 3,654,764 | 4/1972 | Hubbell | 60/324 |
| 3,695,851 | 10/1972 | Perga | 422/176 |
| 3,713,783 | 1/1973 | Greipel | 422/176 |
| 3,780,772 | 12/1973 | Carnanhan et al. | 422/177 |
| 3,819,334 | 6/1974 | Yoshida et al. | 422/176 |
| 3,929,420 | 12/1975 | Wood | 422/176 |
| 4,002,433 | 1/1977 | Oser | 422/176 |

FOREIGN PATENT DOCUMENTS

| | | | |
|---|---|---|---|
| 972972 | 8/1975 | Canada | 422/176 |
| 2364425 | 7/1975 | Fed. Rep. of Germany | 422/179 |
| 1406704 | 9/1975 | United Kingdom | 422/179 |

*Primary Examiner*—Bradley R. Garris

*Attorney, Agent, or Firm*—Toren, McGeady and Stanger

[57] ABSTRACT

An exhaust muffler has a monolithic honeycomb catalyst mounted within an oblong shaped casing. An inlet conveys exhaust gas into one end of the casing and an outlet flows the exhaust gas away from the other end. At its end spaced from the casing the inlet is generally round while its end connected to the casing has a shape conforming to that of the casing. The sides of the inlet taper outwardly providing a smooth surface for the flow path to the casing. A flow dividing member traverses the flow path in the inlet between its ends for dividing the flow without causing any turbulence.

8 Claims, 3 Drawing Figures

EXHAUST MUFFLER WITH CATALYST

SUMMARY OF THE INVENTION

The present invention is directed to an exhaust muffler containing a monolithic honeycomb catalyst and, more specifically, it is directed to the arrangement of the inlet to the muffler provided with a flow dividing member for distributing the exhaust gases across the full transverse cross-section of the catalyst.

In known inlet sections to casings containing a catalyst, the flow is such that most of it follows a rectilinear central path through the inlet into the catalyst. As a result, the outer regions of the catalyst contribute little to the cleaning of the exhaust gases, while the central zone is overloaded due to overheating or contamination so that its useful life is prematurely shortened.

Therefore, it is the primary object of the present invention to improve the inlet flow to a catalyst within an exhaust muffler so that the flow is distributed evenly across the complete transverse cross-section of the catalyst without any appreciable loss of pressure.

In accordance with the present invention, an exhaust muffler is provided with a causing having an oblong shaped cross-section in which a monolithic honeycomb catalyst is mounted. An axially extending tubular shaped inlet section conveys the exhaust gases into the catalyst. The inlet section changes from a round section at its end spaced from the casing to a cross-section corresponding to that of the casing at its end adjacent the catalyst. The cross-section of the inlet section increases in size toward the catalyst. A flow dividing member is located within the inlet section intermediate its ends and divides the flow path through the inlet section into two parts. The inner surface of the inlet section and the dividing member are shaped so that exhaust gases passing through the inlet section do not experience a turbulent flow.

The arrangement of the muffler in accordance with the present invention provides a flow distribution into the catalyst which is a significant improvement over the known arrangements. In the past, a perforated plate has been provided extending across the entire cross-section of the inlet to the catalyst and it caused considerable counter-pressure. Furthermore, the plate was subjected to considerable wear. In another known arrangement, a flow divider was inserted into the muffler in front of the catalyst, however, it proved to be expensive and particularly susceptible to problems. In still another known arrangement the inlet flow path was divided into a number of parallel inlet channels extending from a common exhaust pipe, however, this arrangement was also expensive and tended to result in problems.

The arrangement embodying the present invention results in a considerable advantage in the formation of the inlet section by constructing it of two half shells connected together in the plane of the major axis of the oblong casing containing the catalyst. The flanges can be connected together by welding. Further, the flow divider in the inlet section can be provided by indentations formed in each of the shells with the indentations connected together by welding.

In addition, the outlet section of the exhaust muffler can be constructed in the same way as the inlet section.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
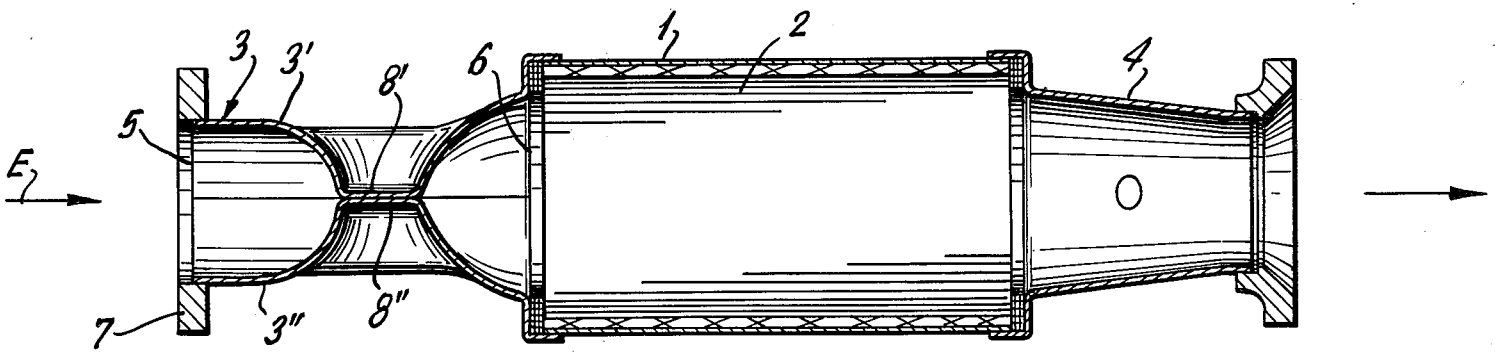
FIG. 1 is an axially extending cross-section of an exhaust muffler embodying the present invention taken along the lines A–B in FIG. 3.

In the drawings, an exhaust muffler is shown having an oval or oblong shaped sheet metal casing 1 in which a monolithic honeycomb catalyst 2 is resiliently mounted in a known manner. The casing 1 provides a lateral seal around the catalyst. An axially extending inlet section 3 is provided at one end of the casing and an axially extending outlet section 4 is located at the other end of the casing. The inlet and outlet sections 3, 4 are joined to the casing by welding.

Figure 2:
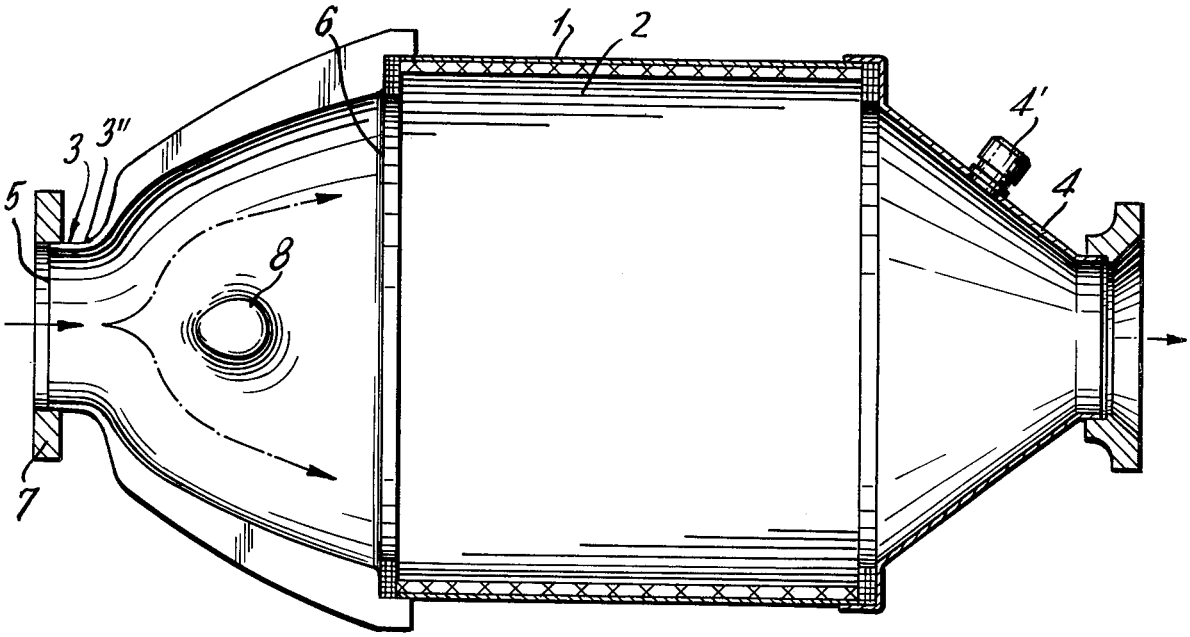
FIG. 2 is an axially extending cross-section of the exhaust muffler shown in FIG. 1, however, it is taken along the line C–D in FIG. 3.
Figure 3:
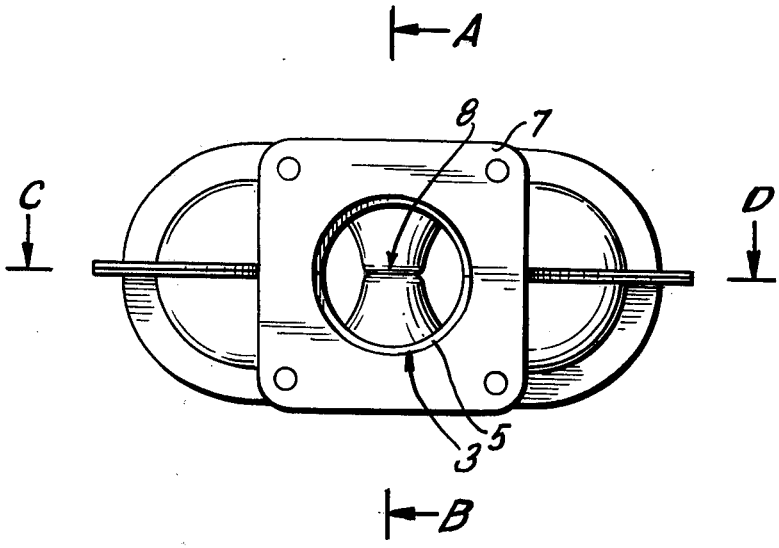
FIG. 3 is an end view of the exhaust muffler taken in the direction of the arrow E shown in FIG. 1.

As can be seen best in FIGS. 2 and 3, the inlet section 3 changes from a circular cross-section 5 at its inlet end to a significantly larger cross-section at its end 6 connected to the casing 1. A flange 7 extends around the circular cross-section end 5 of the inlet section. The end 6 of the inlet section corresponds to the cross-sectional shape of the casing 1, that is, it has a shape similar to that of the monolithic catalyst 2 held within the casing 1. The outlet section 4 is constructed in a similar manner, that is, it has an oblong cross-sectional shape at its end connected to the casing and a rounded shape at its end spaced outwardly from the casing. As shown in FIG. 2, the outlet section has an opening 4' for supplying additional air into the exhaust muffler. The opening 4' is located intermediate the ends of the outlet section.

The inlet section 3 is constructed of two similarly shaped shells 3' and 3''. Each of the shells has a pair of edge flanges extending in the axial direction of the inlet section. The flanges on the shells are welded together. As can be seen in FIGS. 1 and 2, the flanges of the inlet section are located in a plane extending along the major axis C–D of the casing 1. Approximately equidistantly spaced from each of the ends of the inlet section, both of the shells 3', 3'' are provided with similar indentations 8', 8'' for forming a flow dividing member 8 in the flow path through the inlet section 3. The indentations 8', 8'' are welded together. As can be seen in FIG. 2, in section taken parallel to the plane of the major axis C–D of the casing, the flow dividing member 8 has an ovoid shape so that it provides a streamline flow for the exhaust gases flowing through the inlet section into the catalyst 2 in the casing 1. The flow dividing member separates the flow path into two parts. Because of the streamlined arrangement of the flow dividing member 8 and the smooth outwardly tapering surfaces of the shells forming the flow path into the catalyst, the division of the flow path occurs without any turbulence and assures a more uniform distribution of the gas flow across the entire transverse cross-section of the catalyst. The flow dividing member 8 is spaced centrally between the ends of the inlet casing and between its sides for effecting the optimum flow distribution.

While specific embodiments of the invention have been shown and described in detail to illustrate the application of the inventive principles, it will be understood that the invention may be embodied otherwise without departing from such principles.

What is claimed is:

1. In an exhaust muffler construction comprising an axially elongated tubular casing of oval shaped transverse cross-section and having an inlet at one end thereof and an outlet at the opposite end thereof, the transverse cross-section has a major axis and a minor axis, a monolithic honeycomb catalyst is mounted in said casing extending between the inlet and outlet thereof so that flow of exhaust gases can pass from the inlet to the outlet through said catalyst, an axially elongated tubular shaped inlet section having a first end and a second end with the second end being connected to the inlet to said casing and having a transverse cross section corresponding to the transverse cross section of said casing, said inlet section having an axis extending between the first and second ends thereof in general alignment with the axis of said tubular casing, said first end having a transverse cross section significantly smaller than said second end, the inlet section having first side surfaces extending generally in the direction of said minor axis and tapering outwardly from the first end to the second end so that said side surfaces provide a smooth transition from the first end of said inlet section to the inlet to said casing, and second side surfaces extending generally transversely of said first side surfaces, wherein the improvement comprises a gas flow dividing member for providing a more uniform distribution of the gas flow across the entire transverse cross section of said catalyst, said dividing member located within said inlet section centrally between and spaced from both the first and second ends thereof and said first side surfaces and extending completely across the flow path through said inlet section in the direction of said minor axis between said second side surfaces of said casing and dividing the flow path generally symmetrically into a first section extending from the first end of said inlet section to the surface of said flow dividing member closer to the first end of said inlet section, a second section extending along the dimension of said flow dividing member on both sides thereof in the direction between the first and second ends of said inlet section and a third section extending from the surface of said flow dividing member closer to the second end of said inlet section to the second end of said inlet section with the first and third sections each forming a single flow passage connected by two flow passages formed in the second section, and said dividing member having a width dimension in the direction of said major axis which varies in the direction from the first end toward the second end of said inlet section.

2. An exhaust muffler construction, as set forth in claim 1, wherein the first end of said inlet section has a round cross-sectional shape.

3. An exhaust muffler construction, as set forth in claim 1, wherein said dividing member has a streamlined curvilinear configuration in the plane containing said major axis of said tubular casing so that the division of the flow of the exhaust gases takes place with a minimum of turbulence.

4. An exhaust muffler construction, as set forth in claim 1, wherein said inlet section is formed of a pair of symmetrically shaped shells each forming one of said second side surface and a part of each of said first side surfaces, each said shell having a flange extending along the pair of opposite said first side surfaces extending between the first and second ends of said inlet section and said flanges are located in the plane of the major axis of said casing, and said shells being joined together along said flanges.

5. An exhaust muffler construction, as set forth in claim 4, wherein said flow dividing member is formed by an indentation provided in said second surface formed in each of said shells with said indentations being joined together in the plane of the major axis of said casing.

6. An exhaust muffler construction, as set forth in claim 5, wherein said dividing member has an ovoid cross-section in the plane of the major axis of said casing, with the ovoid cross-section having a smaller diameter end closer to the first end of said inlet section and a larger diameter end closer to the second end of said inlet section.

7. An exhaust muffler construction, as set forth in claim 1, including an axially elongated tubular shaped outlet section having a first end and a second end with the second end being connected to the outlet from said casing and having a transverse cross-sectional shape corresponding to the transverse cross-sectional shape of said casing, said first end having a transverse cross-section significantly smaller than said second end and said outlet section having side surfaces tapering inwardly from the second end to the first end thereof.

8. An exhaust muffler construction, as set forth in claim 7, wherein an air connection is fixed to said outlet section and is located on the outer surface thereof, said air connection being spaced from the first and second ends of said outlet section.

* * * * *